US008302444B2

(12) United States Patent
Hermann

(10) Patent No.: US 8,302,444 B2
(45) Date of Patent: Nov. 6, 2012

(54) METHOD FOR FOLDING AN EDGE OF A SHEET COMPONENT IN PARTICULAR A SHEET COMPONENT OF A MOTOR VEHICLE CHASSIS

(75) Inventor: Mario Hermann, Wiesloch (DE)

(73) Assignee: ThyssenKrupp Drauz Nothelfer GmbH, Heilbronn (DE)

( * ) Notice: Subject to any disclaimer, the term of this patent is extended or adjusted under 35 U.S.C. 154(b) by 845 days.

(21) Appl. No.: 12/304,908

(22) PCT Filed: May 22, 2007

(86) PCT No.: PCT/EP2007/054946

§ 371 (c)(1),
(2), (4) Date: May 15, 2009

(87) PCT Pub. No.: WO2007/147692

PCT Pub. Date: Dec. 27, 2007

(65) Prior Publication Data

US 2009/0301158 A1 Dec. 10, 2009

(30) Foreign Application Priority Data

Jun. 21, 2006 (DE) ..... 10 2006 028 833

(51) Int. Cl.
*B21D 7/02* (2006.01)

(52) U.S. Cl. ..... 72/214

(58) Field of Classification Search ..... 72/210, 72/214, 220, 199, 252.5; 29/243.57, 243.58
See application file for complete search history.

(56) References Cited

U.S. PATENT DOCUMENTS

| | | | | |
|---|---|---|---|---|
| 2,091,474 | A * | 8/1937 | Elliott | 72/48 |
| 3,680,346 | A * | 8/1972 | Wilcox | 72/211 |
| 5,224,253 | A | 7/1993 | Sawa | 29/243.58 |
| 6,161,410 | A * | 12/2000 | Shook et al. | 72/220 |
| 6,425,277 | B2 * | 7/2002 | Wiens | 72/210 |
| 6,477,879 | B1 | 11/2002 | Sawa | 72/220 |
| 6,810,707 | B2 * | 11/2004 | Friedman et al. | 72/220 |
| 6,983,633 | B2 * | 1/2006 | Holmgren et al. | 72/220 |
| 7,290,423 | B2 * | 11/2007 | Carsley et al. | 72/214 |
| 2003/0209048 | A1 | 11/2003 | Friedman et al. | 72/220 |

(Continued)

FOREIGN PATENT DOCUMENTS

DE 1115693 10/1961

(Continued)

OTHER PUBLICATIONS

English translation of German application, DE 1115693, that was cited in previous IDS, Oct. 26, 1961.

(Continued)

*Primary Examiner* — Edward Tolin
(74) *Attorney, Agent, or Firm* — Crowell & Moring LLP

(57) ABSTRACT

According to the invention, folding a sheet edge at high folding speed with no faults may be achieved, wherein a conically contoured folding roller is used with an inclined attitude to the direction of movement thereof, firstly engaging the edge of the sheet for folding with the front region of the largest diameter thereof and then continuously folding the edge of the sheet until contact is made with the limiting part of the sheet component continuously over the conical region until the region of the smallest diameter thereof is reached.

5 Claims, 1 Drawing Sheet

U.S. PATENT DOCUMENTS

| | | | | |
|---|---|---|---|---|
| 2004/0035172 | A1 | 2/2004 | Sawa | 72/214 |
| 2005/0262912 | A1 * | 12/2005 | Toeniskoetter | 72/220 |

FOREIGN PATENT DOCUMENTS

| | | | |
|---|---|---|---|
| DE | 10392607 | | 6/2005 |
| EP | 0525759 | | 2/1993 |
| EP | 1097759 | | 5/2001 |
| EP | 1445043 | | 8/2004 |
| JP | 2-70325 | * | 3/1990 |

OTHER PUBLICATIONS

International Search Report for International Application No. PCT/EP2007/054946.

* cited by examiner

METHOD FOR FOLDING AN EDGE OF A SHEET COMPONENT IN PARTICULAR A SHEET COMPONENT OF A MOTOR VEHICLE CHASSIS

CROSS-REFERENCE TO RELATED APPLICATIONS

This application is a National Phase Application of International Application No. PCT/EP2007/054946, filed on May 22, 2007, which claims the benefit of and priority to German patent application no. DE 10 2006 028 833.5-14, filed Jun. 21, 2006. The disclosure of the above applications are incorporated herein by reference in their entirety.

FIELD OF THE INVENTION

The invention relates to a method for folding an edge of a sheet metal component, in particular a door, a flap or a similar component of a motor vehicle body, wherein the bent edge is brought into contact with the adjoining part of the sheet metal component by means of a folding roller guided along this edge, wherein a roller which is conically contoured on its circumferential periphery (outer surface) having its axis of rotation inclined with respect to the plane of the sheet metal component is used as the folding roller, in that the roller first strikes against the border of the bent edge in the movement direction with its front region having its larger diameter and then folds the edge continuously over the conical region of its outer surface to the region having its smallest diameter until contact is made with the adjoining part of the sheet metal component.

BACKGROUND

In methods, which are common in practice, for folding an edge with and without an edge of another sheet metal component to be clamped in the fold, the bent edge is folded in several stages by means of a folding roller whose outer surface is cylindrical. Even in the case of this multiple-stage folding, a material bulge in advance of the folding roller develops at higher operational speeds, which then leads to a critical speed being exceeded whereupon the folding roller skips over the material bulge which leads to folding errors. As a result, the operational speed of the folding roller, depending upon the thickness of the sheet metal to be folded, is limited to 200 mm/s.

A method for folding an edge of a sheet metal component of the type mentioned in the introduction is known (EP 1 445 043 A1, FIGS. 4 and 5 of the associated text). In this method, the axis of rotation of the conically contoured roller is only inclined with respect to the plane of the sheet metal component to be folded. This produces a comparatively short section of the folding process in the movement direction of the roller. As a result, considerable deformation forces are required and there is a risk of producing a suboptimum folding result.

SUMMARY OF THE INVENTION

In general, one aspect of the invention is to provide a folding method which can be performed at a high folding speed and with a high degree of process safety.

A method in accordance with an embodiment of the invention provides that the axis of rotation of the folding roller is inclined with respect to the movement direction.

In the folding method in accordance with the invention, folding is performed in a single stage. Owing to the particular shape of the folding roller and its oblique inclination (inclined twice: its axis of rotation is inclined a) with respect to the plane of the sheet metal component and b) with respect to its movement direction) it strikes against the edge to be bent over a longer path as a cylindrical folding roller having its axis inclined perpendicularly with respect to the movement direction. As a result, in contrast to a method using a cylindrical roller, no material bulges are formed in advance as in conventional methods and devices resulting in folding errors. This provides the additional advantage that the method in accordance with the invention can be performed at a comparatively high folding speed, e.g., at least 800 m/s, in particular 1200 m/s and above.

It is particularly favorable for the folding process if the conical outer surface has the contour of a groove. The contour then preferably corresponds to a half-parabola. However, in the strictest mathematical sense the contour does not have to be parabolic; other contours are also feasible, e.g., tractrix curve, also called drag/tow curve.

The folding roller is preferably driven.

The roller folding method in accordance with the invention functions in a particularly efficient manner if substantially cylindrical edge regions adjoin the conical region.

It should be understood that the specific geometric contour depends upon the roller and its inclination with respect to the fold, its material thickness and the flow behavior of the material. However, the user can easily determine the optimum combination of parameters by field tests. The relative geometric ratios and movements between the folding roller and the edge to be folded can be achieved in many ways. The edge can be held in a stationary manner and the roller moved and inclined or vice-versa or a combination thereof. The means used can be slots, rails, driving/guiding/adjusting means (robotics).

BRIEF DESCRIPTION OF THE DRAWINGS

The invention will be described in more detail hereinafter with the aid of a drawing illustrating a specific exemplified embodiment and in which.

DESCRIPTION

Figure 1:
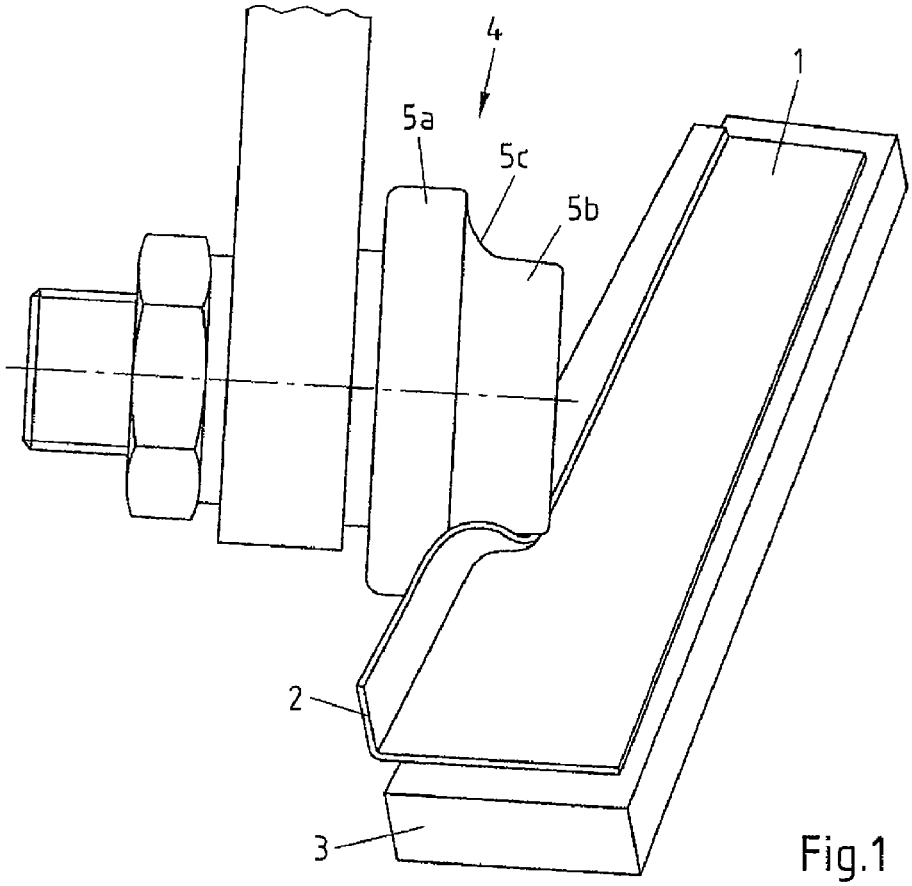
FIG. 1 shows a perspective view of a folding roller and a sheet metal component to be folded during the folding process as seen from the direction opposite the movement direction.
Figure 2:
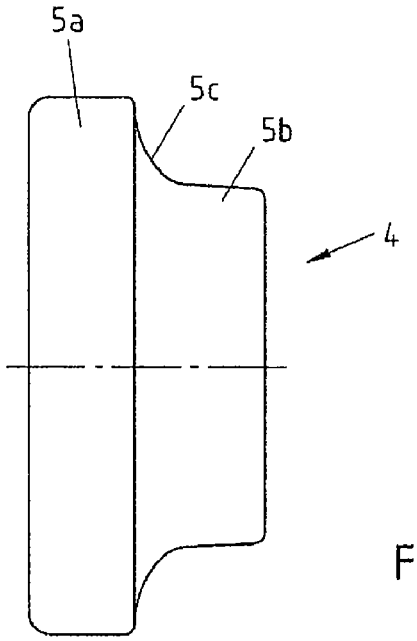
FIG. 2 shows an axial cross-section of the folding roller.

The method in accordance with the invention can be used for a sheet metal component having a single fold or for a sheet metal component involving a further sheet metal component. The exemplified embodiment shows a method for folding a single fold.

For this purpose, the sheet metal component 1 having a bent, upwardly-protruding edge 2 is fixed in position on a bed 3. The bed 3 can be disposed so as to be stationary or it can be moved depending upon which component is to be folded.

A contoured free-running or driven folding roller 4 is mounted above the bed 3 so as to be displaceable in the longitudinal direction of the edge 2 and in parallel therewith. The driving and guiding means required for this purpose are not shown in the drawing. The outer surface 5 of the folding roller 4 is composed of two outer edge regions 5*a*, 5*b* and a central region 5*c*, wherein the outer edge regions 5*a*, 5*b* are cylindrical in shape and the central region 5*c* mainly responsible for the folding process has the shape of a cone. Specifically, the central region 5*c* has the contour of a groove, the generatrix thereof being a half-parabola, wherein the central region 5*c* comprising the groove terminates on one side in one step on the outer region 5*a* having the largest diameter of the folding roller 4 and becomes on the other side continuously the outer region 5*b* having the smallest diameter.

Such a folding roller 4 can be inclined in an oblique manner with respect to its movement direction along the fold by means of the guiding and inclining means, not illustrated, such that as the folding roller 4 moves it first strikes against the upwardly-protruding edge 2 with its advancing side of its outer region 5*a* having its largest diameter and thus triggers the folding process. The edge 2 then slides over the central region 5*c*, wherein it is further folded until it is finally pressed to contact the flat sheet metal component 1 by the region 5*b* having its smallest diameter. Depending upon the contour of the folding roller 4, flat or also teardrop-shaped folds (e.g., Eurogrooves) can be formed in this manner. In each case, the folding process is performed continuously and at a high folding speed. Folding thus occurs in a single stage, i.e., in one working step. Multi-stage folding steps, as known from the described conventional methods and devices, are not required. The risk of folding errors is minimized owing to the particular shape and inclination of the folding roller 4.

The invention claimed is:

1. Method for folding an edge of a sheet metal component, wherein the edge is brought into contact with an adjoining part of the sheet metal component by means of a folding roller guided along the edge, wherein a roller which is conically contoured on an outer surface and having an axis of rotation inclined with respect to a plane of the sheet metal component is used as the folding roller, wherein a folding roller axis of rotation is also inclined with respect to a movement direction, wherein cylindrical edge regions adjoin a conical region of the folding roller, wherein the folding roller is inclined in an oblique manner with respect to its movement direction along the fold by guiding and inclining means such that as the folding roller moves it first strikes against the edge with its advancing side of its cylindrical outer region having a largest diameter and thus triggers the folding process, wherein the edge then slides over the conical region, wherein the edge is further folded until it is finally pressed to contact the flat sheet metal component by the cylindrical region having a smallest diameter.

2. Method for folding as claimed in claim 1, wherein the conical region of the outer surface has a contour of a groove.

3. Method as claimed in claim 2, wherein the contour of the groove corresponds to a half-parabola.

4. Method as claimed in claim 1, wherein the contoured roller is driven.

5. Device for folding an edge of a sheet metal component, the device including a folding roller, wherein the folding roller is formed as a roller which is conically contoured on circumferential periphery of the folding roller, wherein an axis of rotation of the folding roller is configured inclined with respect to a plane of the sheet metal component so that as the folding roller is guided along a bent edge it is brought into contact with an adjoining part of the sheet metal component, wherein substantially cylindrical edge regions adjoin the conical region of the folding roller, wherein the folding roller is configured inclined in an oblique manner with respect to its movement direction along the fold by guiding and inclining means such that as the folding roller moves it first strikes against the upwardly-protruding portion of the bent edge with its advancing side of its cylindrical outer region having a largest diameter and thus triggers the folding process, wherein the bent edge is further folded until it is finally pressed to contact the flat sheet metal component by the cylindrical region having a smallest diameter.

* * * * *